US007597397B2

(12) United States Patent
McCoy et al.

(10) Patent No.: US 7,597,397 B2
(45) Date of Patent: Oct. 6, 2009

(54) SWIVEL ROCKER ASSEMBLY

(75) Inventors: Ryan McCoy, Flacon Heights, MN (US); Stacy Abel, Maple Grove, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 11/863,363

(22) Filed: Sep. 28, 2007

(65) Prior Publication Data

US 2009/0085386 A1 Apr. 2, 2009

(51) Int. Cl.
*A47C 3/029* (2006.01)

(52) U.S. Cl. ..... 297/259.1; 297/270.2; 297/271.6; 297/344.21

(58) Field of Classification Search ..... 297/258.1, 297/259.1, 263.1, 263.2, 270.5, 271.5, 271.6, 297/344.21, 344.22, 344.26
See application file for complete search history.

(56) References Cited

U.S. PATENT DOCUMENTS 875,494 A * 12/1907 Bedell ..... 384/603
1,395,698 A * 11/1921 Baum et al. ..... 472/25
1,662,947 A 3/1928 Banker
2,560,963 A * 7/1951 Kornegay ..... 472/135
3,556,591 A 1/1971 Smith
3,697,131 A * 10/1972 Thompson ..... 297/263.1
3,749,399 A 7/1973 Fedor et al. ..... 272/33
4,025,107 A 5/1977 Chippa ..... 297/17
4,183,521 A * 1/1980 Kroeker ..... 482/146
4,193,592 A 3/1980 Bishow ..... 272/114
4,236,752 A 12/1980 Mizelle ..... 297/303
5,186,424 A * 2/1993 Shultz et al. ..... 248/179.1
5,294,176 A * 3/1994 Asinovsky ..... 297/245
5,419,613 A 5/1995 Wedeking ..... 297/217.1
5,688,211 A * 11/1997 Myers ..... 482/66

(Continued)

*Primary Examiner*—David Dunn
*Assistant Examiner*—Patrick Lynch
(74) *Attorney, Agent, or Firm*—Theodore M. Magee; Westman, Champlin & Kelly, P.A.

(57) ABSTRACT

A swivel rocker is provided that includes a surface designed to contact a floor so as to facilitate rocking in two directions along a line while limiting rocking in other directions and to inhibit excessive rocking in at least one direction along the line. The swivel rocker also includes a swivel portion such that a seat may be rotated relative to the two directions of facilitated rocking. The swivel portion allows a user to alter the directions of facilitated rocking relative to their orientation on the seat. The rocking surface inhibits excessive rocking in the at least one direction to help prevent the user from tipping over in the chair. Under some embodiments, the swivel rocker is formed of two rockers having a curved portion designed to contact the floor and an additional portion that inhibits excessive rocking. The additional portion extends from the curved portion in several embodiments.

10 Claims, 10 Drawing Sheets

U.S. PATENT DOCUMENTS

| | | | | |
|---|---|---|---|---|
| 5,810,751 | A | 9/1998 | Meier et al. | 601/24 |
| 5,887,944 | A | 3/1999 | Boost | 297/258.1 |
| 6,024,409 | A | 2/2000 | Collins | 297/271.6 |
| 6,089,663 | A | 7/2000 | Hill | 297/258.1 |
| 6,283,546 | B1 | 9/2001 | Hill | 297/271.1 |
| 6,416,123 | B1 * | 7/2002 | Bell | 297/133 |
| D462,537 | S | 9/2002 | Werner | D6/375 |
| D516,824 | S | 3/2006 | Murphy | D6/356 |
| 7,017,991 | B1 | 3/2006 | Zin | 297/271.6 |
| D545,070 | S | 6/2007 | Hutton | D6/334 |
| D556,469 | S | 12/2007 | Adams | D6/374 |
| D557,911 | S | 12/2007 | Herold et al. | D6/356 |
| D557,916 | S | 12/2007 | Dietrich | D6/366 |
| D557,921 | S | 12/2007 | Kane | D6/375 |
| D558,469 | S | 1/2008 | Lade | D6/334 |
| D558,491 | S | 1/2008 | Kane | D6/500 |
| D560,376 | S | 1/2008 | Sempe | D6/334 |
| 2007/0085395 | A1 * | 4/2007 | LaPointe | 297/258.1 |
| 2007/0120404 | A1 * | 5/2007 | Bellows et al. | 297/256.16 |
| 2007/0138850 | A1 | 6/2007 | Oettinger | 297/271.5 |
| 2008/0018160 | A1 | 1/2008 | Otto et al. | 297/411.2 |

* cited by examiner

SWIVEL ROCKER ASSEMBLY

BACKGROUND OF THE INVENTION

Rocking chairs have long been known that allow users to rock forward and back while maintaining side-to-side stability. Forward and back rocking has also been implemented in chairs that can swivel around a fixed base. In such chairs, side-to-side stability is maintained such that the chair is only allowed to rock in a forward-back motion regardless of how the chair is swiveled relative to the base.

The discussion above is merely provided for general background information and is not intended to be used as an aid in determining the scope of the claimed subject matter.

SUMMARY OF THE INVENTION

A swivel rocker is provided that includes a surface designed to contact a floor so as to facilitate rocking in two directions along a line while limiting rocking in other directions and to inhibit excessive rocking in at least one direction along the line. The swivel rocker also includes a swivel portion such that a seat may be rotated relative to the two directions of facilitated rocking. The swivel portion allows a user to alter the directions of facilitated rocking relative to their orientation on the seat to allow the user to select between different rocking orientations while maintaining stability in other non-rocking directions. For example, the user may select to rock side-to-side at times and forward-to-back at other times. The rocking surface inhibits excessive rocking in at least one direction to help prevent the user from tipping over in the chair.

Under some embodiments, the swivel rocker is formed of two rockers having a curved portion designed to contact the floor and an additional portion that inhibits excessive rocking. The additional portion extends from the curved portion in several embodiments.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

During video game play, it is common for users to rock from side-to-side during some games as they physically emulate what is happening to their avatar in the gaming space. In other games, users will want to rock backward and forward. Existing gaming chairs do not allow users to swivel the chair relative to the direction of rocking.

Embodiments described herein provide chairs that can be swiveled relative to a rocker surface. The rocker surface facilitates rocking in two directions along a line, for instance forward and back or side to side. By swiveling the chair, users can rock the chair along any desired line relative to the front of the chair while maintaining stability along other directions. In addition, the rocker surface includes extensions that inhibit excessive rocking to thereby make it more difficult to tip over while rocking in the chair.

Figure 1:
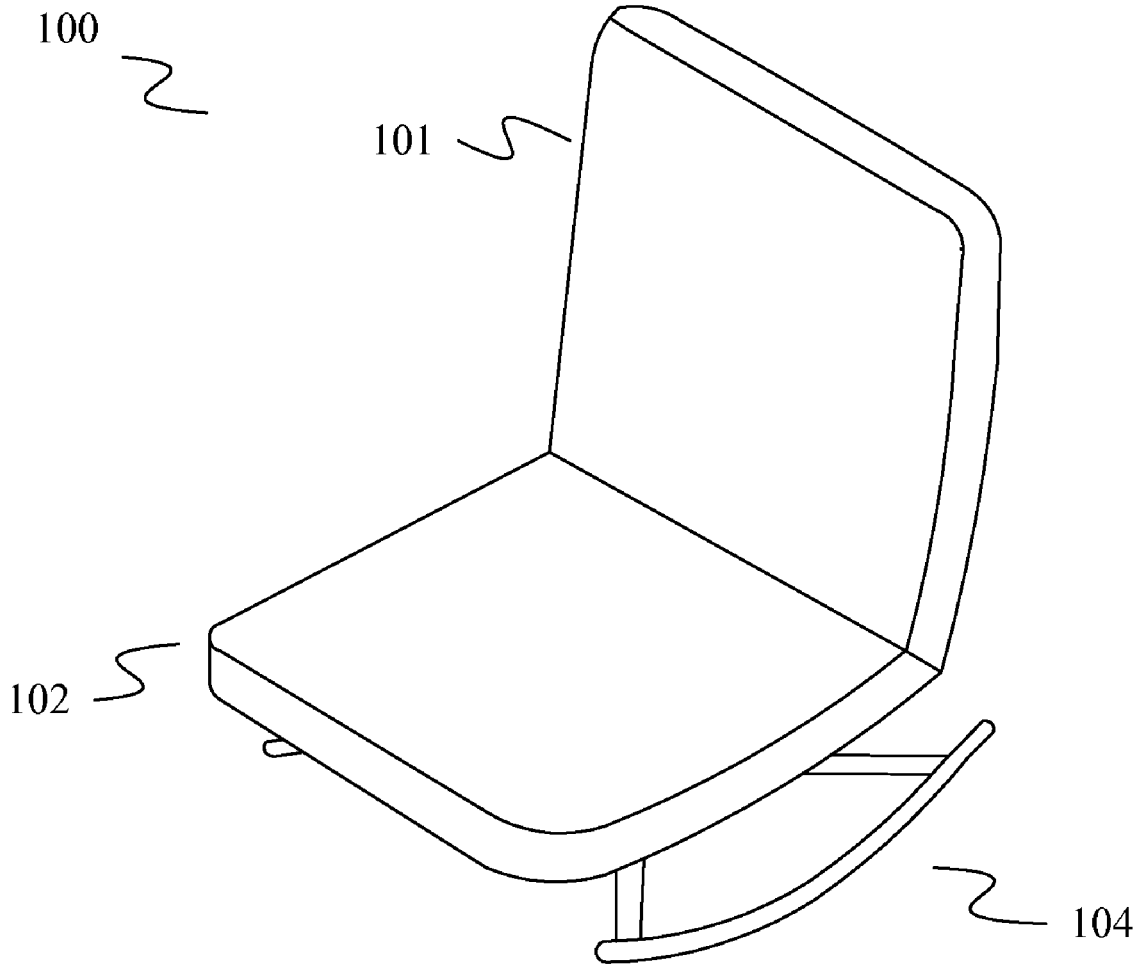
FIG. 1 is a perspective view of one embodiment of a swivel rocker chair.

FIG. 1 is a perspective view of one embodiment of a swivel rocker chair 100. In FIG. 1, the swivel rocker chair has a back 101, a seat 102 and a swivel rocker assembly 104. Back 101 and seat 102 consist of a cover material that contains a frame and fill material. The frame may be constructed of wood, steel, aluminum or plastic and the fill material may be any suitable fill material. The cover may be a woven cloth, fleece, leather or synthetic material.

Figure 2:
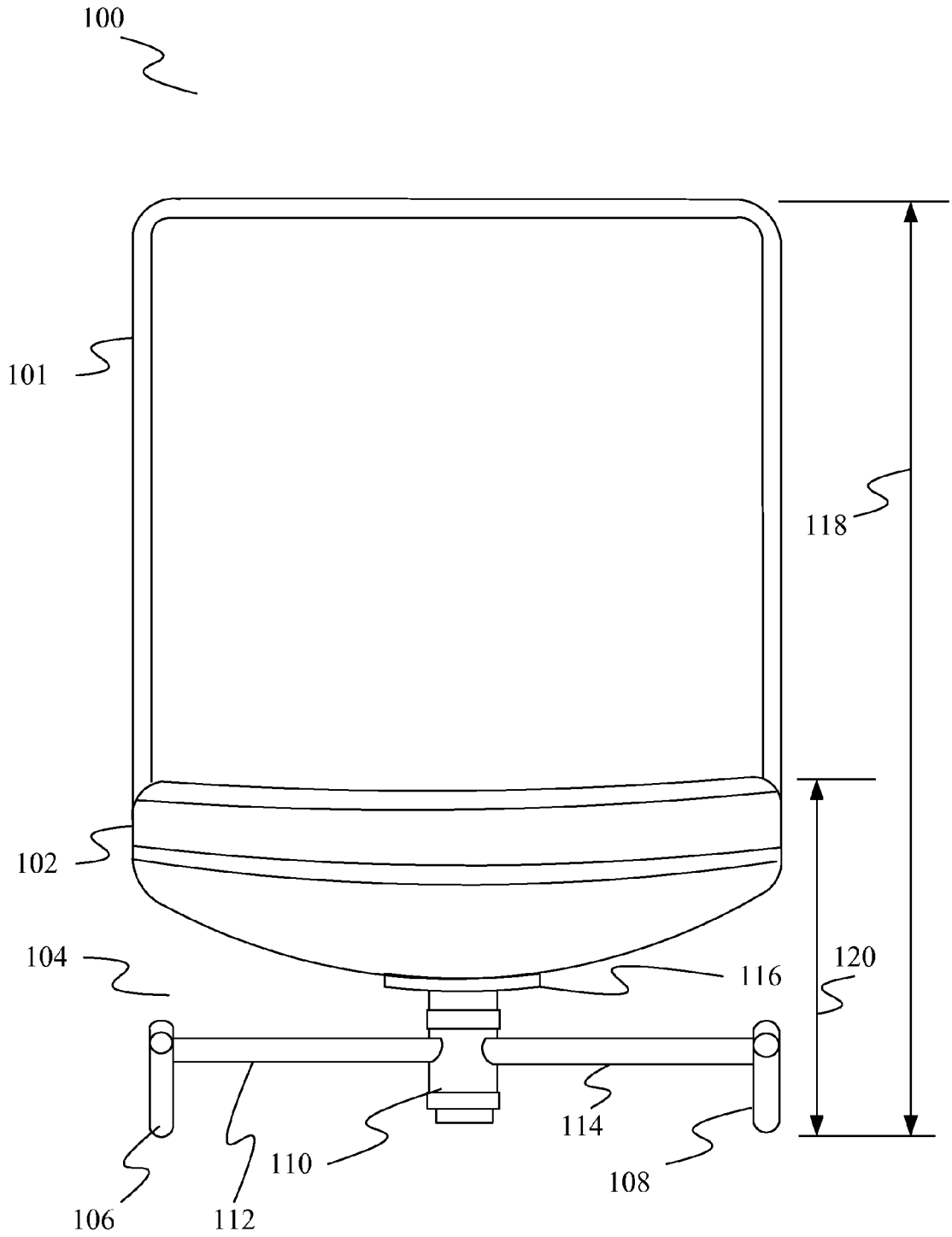
FIG. 2 is a front view of one embodiment of a swivel rocker chair.

FIG. 2 provides a front view of the swivel rocker chair of FIG. 1. In FIG. 2, swivel rocker assembly 104 is shown to include two rockers 106 and 108 that are parallel to each other and that are attached by lateral support members 112 and 114 to a swivel assembly 110 that allows rockers 106 and 108 to swivel relative to a mounting bracket 116 attached to seat 102. Under many embodiments, mounting bracket 116 is attached to a portion of the frame within seat 102 using a fastening mechanism such as screws, nails, rivets, welds or adhesive.

Under several embodiments, the swivel rocker chair is a low-height chair such that a height 118 from the top of back 101 to the bottom of rockers 106/108 is 24 to 25 inches. In such embodiments, the top of seat 102 is a height 120 of 8-9 inches above the bottom of rockers 106/108.

Figure 3:
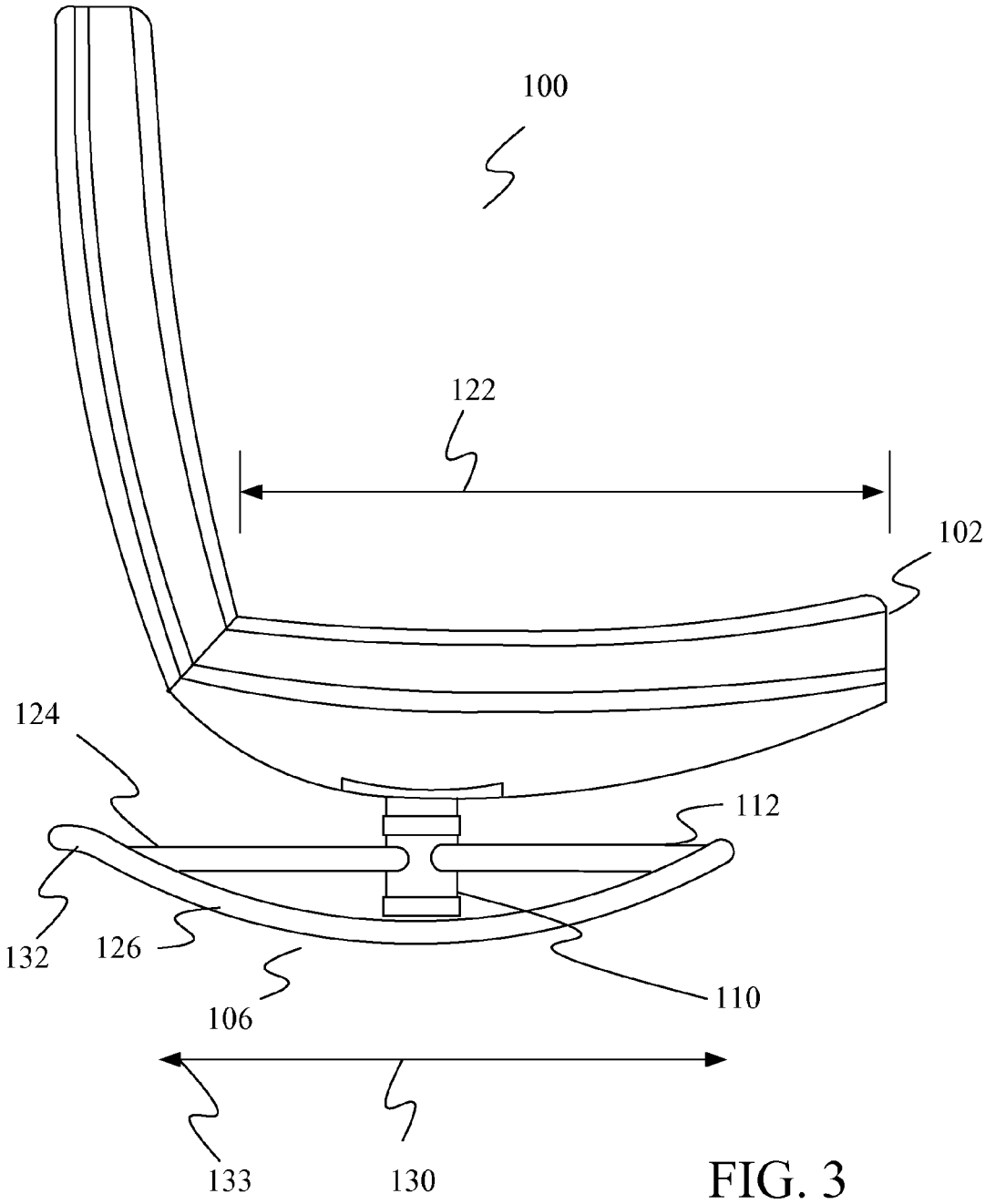
FIG. 3 is a side view of one embodiment of a swivel rocker chair.

FIG. 3 provides a side view of swivel rocker chair 100 of FIG. 1. In FIG. 3, seat 102 is shown to have a depth 122, which under some embodiments is between 16 and 18 inches. In FIG. 3, rocker 106 is shown attached to swivel assembly 110 by lateral supports 112 and 124. Rocker 106 includes a curved portion 126 designed to contact a floor and facilitate rocking along a line 130. Rocker 106 also includes an extension 132 that extends from the end of curved portion 126 to inhibit excessive rocking in direction 133 along line 130. Under some embodiments, curved portion 126 has a radius of curvature of between 17 and 18 inches and extension 132 has a radius of curvature of approximately 3 inches, where the curvature of extension 132 is in an opposite direction to the curvature of curved portion 126. Although extension 132 is shown as being curved in FIG. 3, in other embodiments, extension 132 may be straight as long as extension 132 extends outside of the radius of curvature of curved portion 126 such that if swivel rocker assembly 104 is rocked back toward extension 132, extension 132 will inhibit further rocking.

Under some embodiments, back 101 is attached to seat 102 by a hinge mechanism that allows back 101 to be rotated relative to seat 102 at the hinge point between back 101 and seat 102. Under some of these embodiments, back 101 may be rotated between a position in which back 101 is reclined backwards so that back 101 and seat 102 are in roughly the same plane to a position where back 101 is folded onto seat 102. In further embodiments, the hinge mechanism includes detents that provide additional resistance to moving back 101 relative to seat 102 at certain orientations of back 101. Such detents help users to quickly position back 101 relative to seat 102 by providing an indication of preferred positions.

Figure 4:
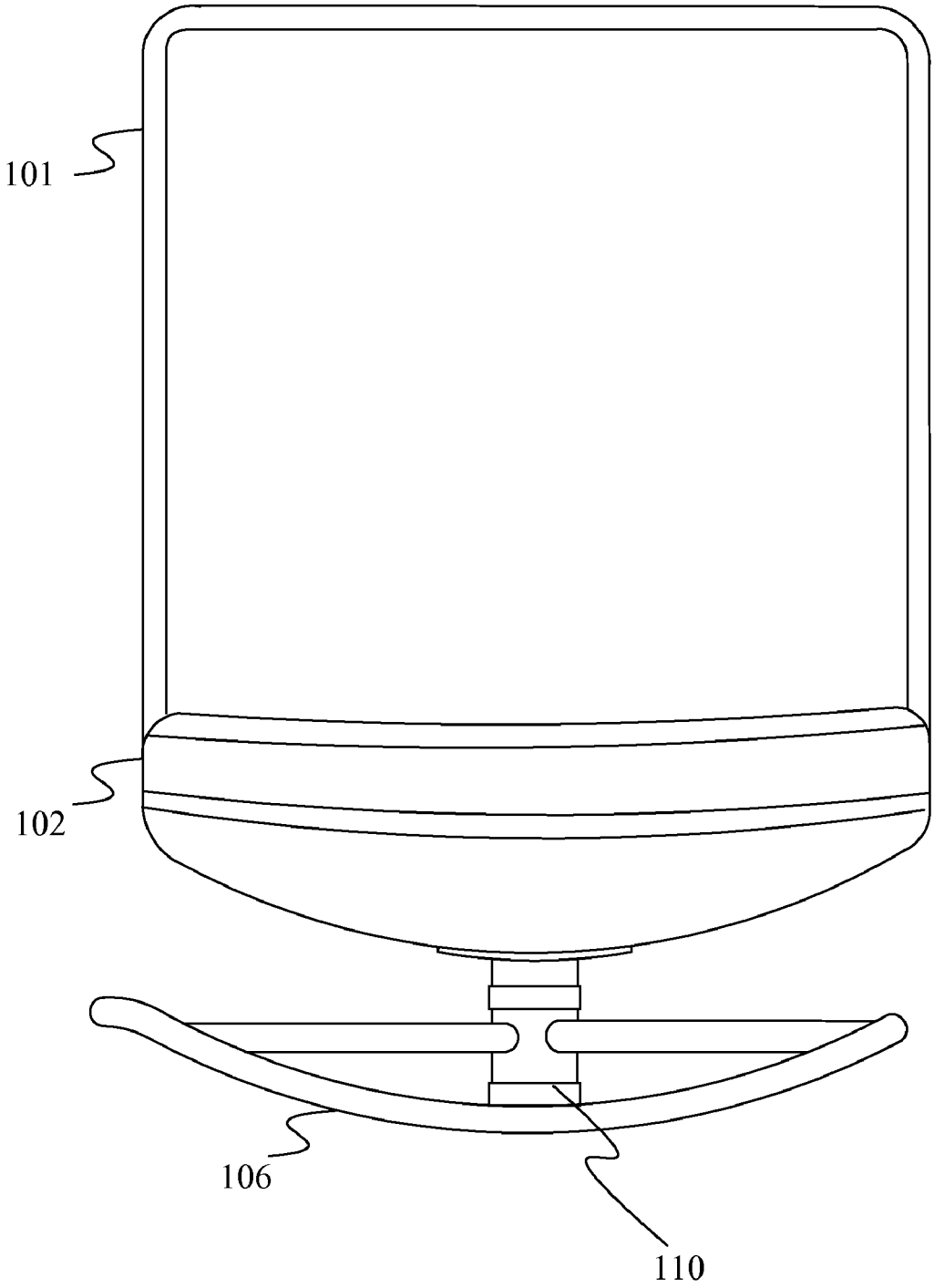
FIG. 4 is a front view of a seat portion with a swivel rocker assembly rotated relative to the front seat portion under one embodiment.

In FIG. 4, seat 102 and back 101 have been swiveled relative to rockers 106 and 108 using swivel assembly 110. As shown in FIG. 4, seat 102 and back 101 are oriented relative to swivel rocker assembly 104 to facilitate rocking side to side when sitting forward in seat 102.

Figure 5:
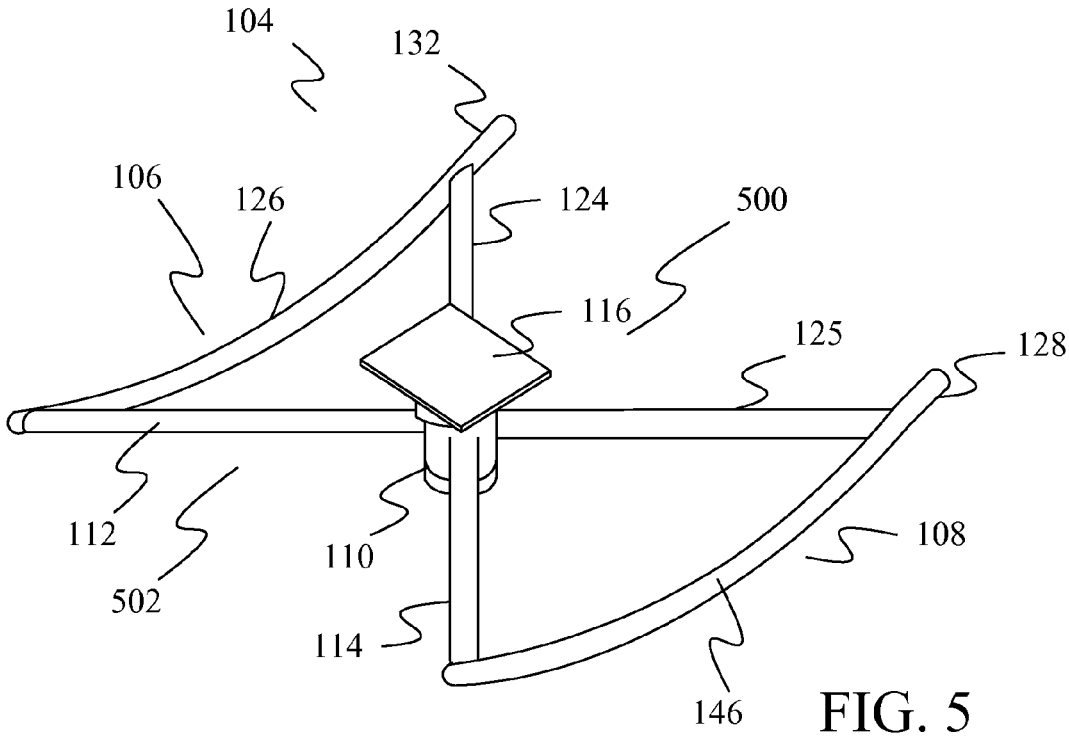
FIG. 5 is a perspective view of a swivel rocker assembly under one embodiment.

FIG. 5 provides a perspective view of swivel rocker assembly 104 showing rockers 106 and 108 attached to swivel assembly 110 by lateral supports 112, 114, 124 and 125. Rockers 106 and 108 and lateral supports 112, 114, 124 and 125 together form a rocker assembly 502, which is also referred to as a rocker portion 502. Mounting bracket 116 is coupled to swivel assembly 110. Rockers 106 and 108 are separated by a space 500 and swivel assembly resides within space 500. Space 500 is defined between the highest point and lowest point of rockers 106 and 108 when rocker assembly 104 is placed on a floor and the horizontal separation between rockers 106 and 108.

Rocker 108 has a curved portion 146 that is similar to curved portion 126 of rocker 106. Rocker 108 also has an extension 128 that extends from curved portion 146 and that inhibits excessive rocking. Under some embodiments, curved portion 146 has a radius of curvature of between 17 and 18 inches and extension 128 has a radius of curvature of approximately 3 inches, where the curvature of extension 128 is in an opposite direction to the curvature of curved portion 146. Although extension 128 is shown as being curved in FIG. 5, in other embodiments, extension 128 may be straight or some other shape as long as extension 128 extends outside of the radius of curvature of curved portion 146 such that if swivel rocker assembly 104 is rocked back toward extension 128, extension 128 will inhibit further rocking. In addition, although extension 128 is shown as having a similar shape to extension 132 in FIG. 5, in other embodiments, extension 128 may have a different shape or be of a different size from extension 132.

Figure 6:
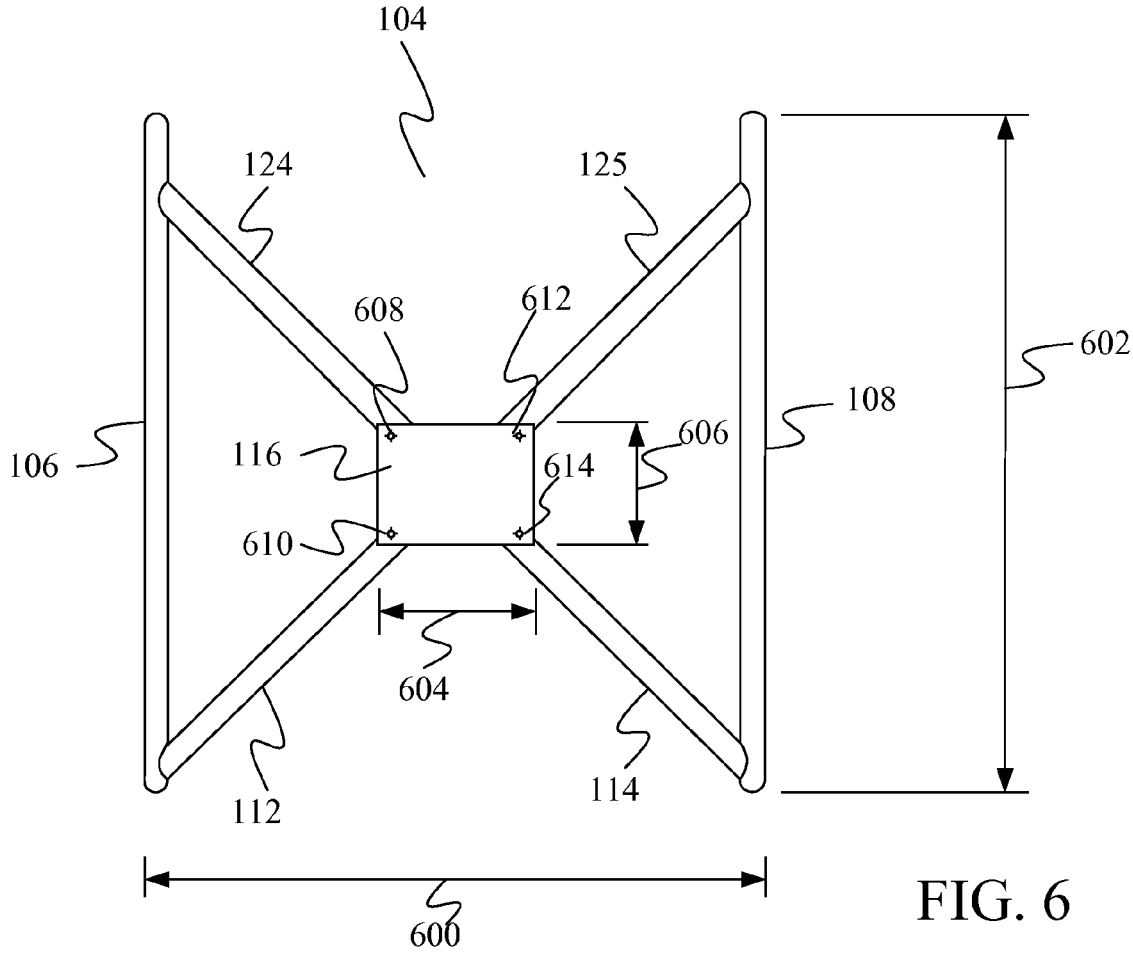
FIG. 6 is a top view of a swivel rocker assembly under one embodiment.

FIG. 6 provides a top view of swivel rocker assembly 104. The outer surfaces of rockers 106 and 108 are separated by a horizontal distance 600 that in some embodiments is 16 inches. Rockers 106 and 108 have a length 602 that under some embodiments is approximately 18 inches, where length 602 is measured along the vertical projection of rockers 106 and 108 on a horizontal plane. Mounting plate 116 has a width 604, which under some embodiments is 4 inches, for example, and a length 606, which is 3-4 inches under some embodiments, for example. Mounting bracket 116 includes mounting holes 608, 610, 612 and 614, under some embodiments. Fasteners, such as screws, for example, may be attached to seat 102 through holes 608, 610, 612 and 614. In other embodiments, mounting plate 116 is mounted to seat 104 using an adhesive or some other bonding material.

Under one embodiment, rockers 106 and 108 and lateral supports 112, 114, 124 and 125 are constructed of tubular steel. In other embodiments, other materials such as wood, titanium or aluminum may be used for these components. In embodiments using tubular steel, lateral support members 112 and 124 are welded to rocker 106 and swivel assembly 110 and lateral support members 114 and 125 are welded to rocker 108 and swivel assembly 110.

Figure 7:
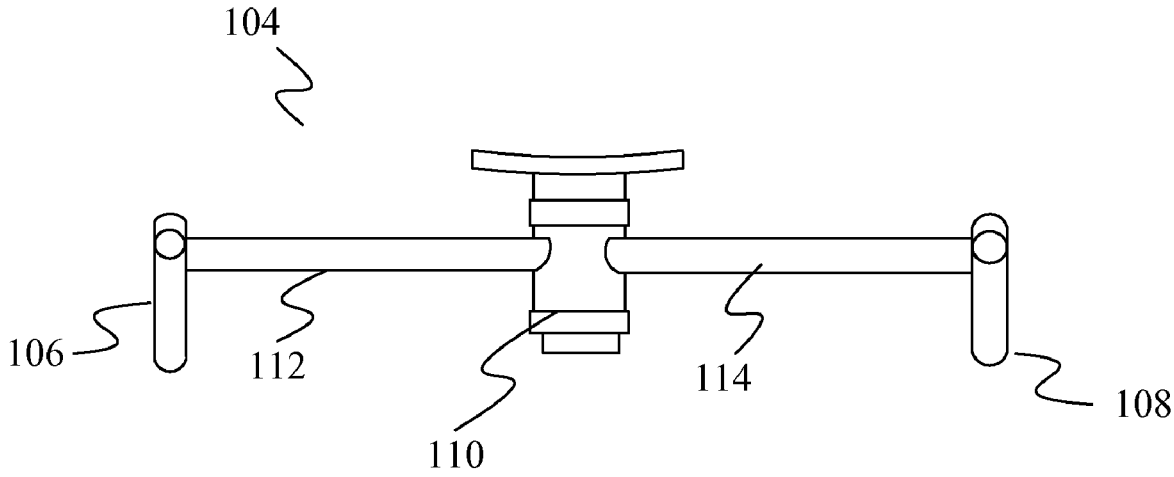
FIG. 7 is a front view of a swivel rocker assembly under one embodiment.

FIG. 7 provides a front view of swivel rocker assembly 104. As shown in the embodiments of FIGS. 3 and 7, lateral supports 112 and 114, as well as lateral supports 124 and 125 extend laterally within a single common plane. Further, as shown in FIGS. 3 and 7, at least a portion of swivel assembly 110 extends below this common plane. This provides a compact structure to swivel rocker assembly 104 allowing it to be used in a low-height chair. Under one embodiment, swivel assembly 110 is cylindrical in shape. In other embodiments, the exterior of swivel assembly 110 may take other forms including a square or hexagonal shape.

Figure 8:
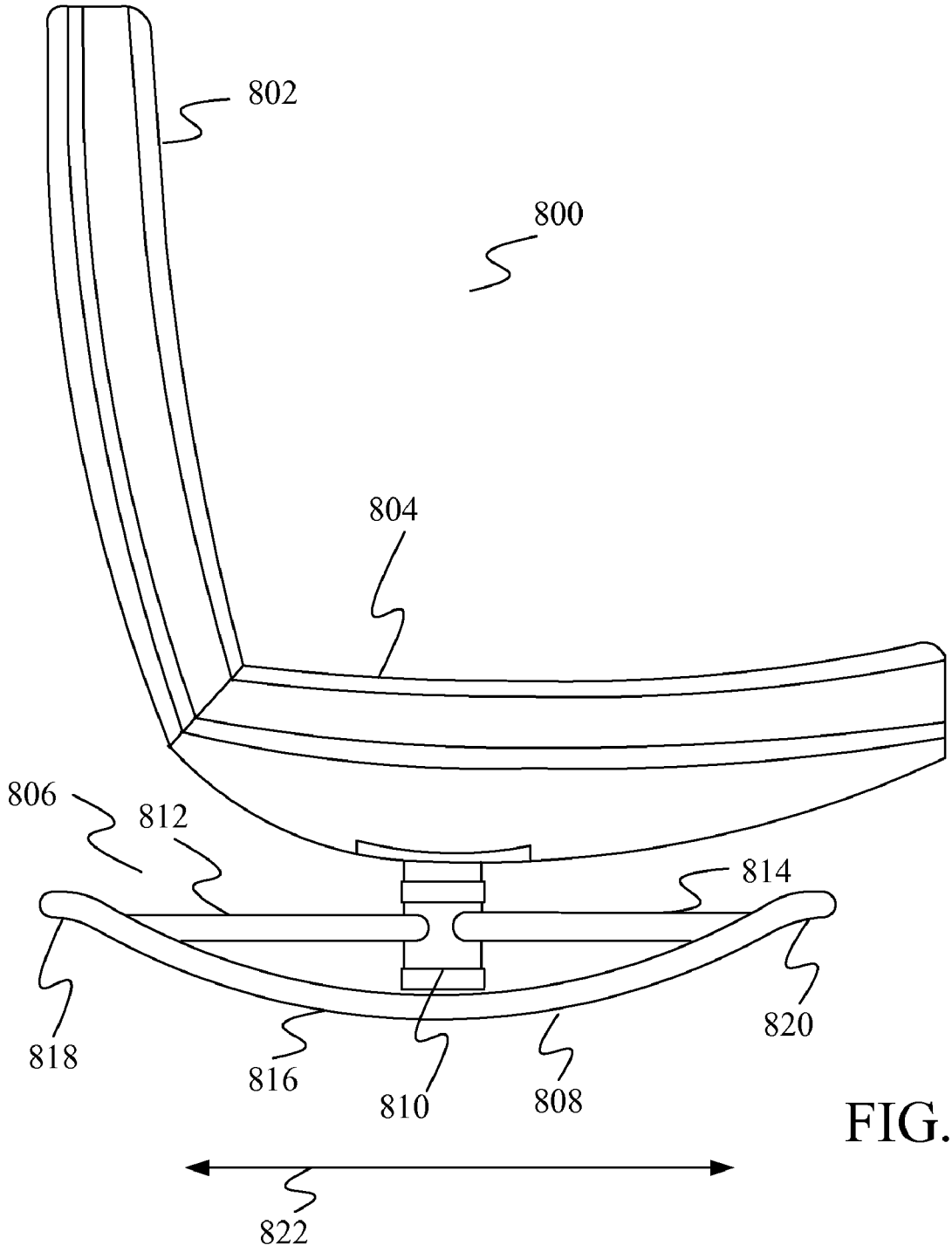
FIG. 8 is a side view of a swivel rocker chair under a second embodiment.

FIG. 8 is a side view of a second embodiment of a swivel rocker chair 800. Swivel rocker chair 800 includes back 802, seat 804 and swivel rocker assembly 806. In the configuration of FIG. 8, swivel rocker assembly 806 allows a user to rock chair 800 forward and back while providing side to side stability.

Swivel rocker assembly 806 includes a swivel portion 810, a rocker 808 and lateral supports 812 and 814. Rocker 808 includes a curved portion 816, a first extension 818 and a second extension 820. First extension 818 and second extension 820 extend outside of the radius of curvature of curved portion 816 to thereby inhibit excessive rocking in either direction along a line of facilitated rocking 822.

Figure 9:
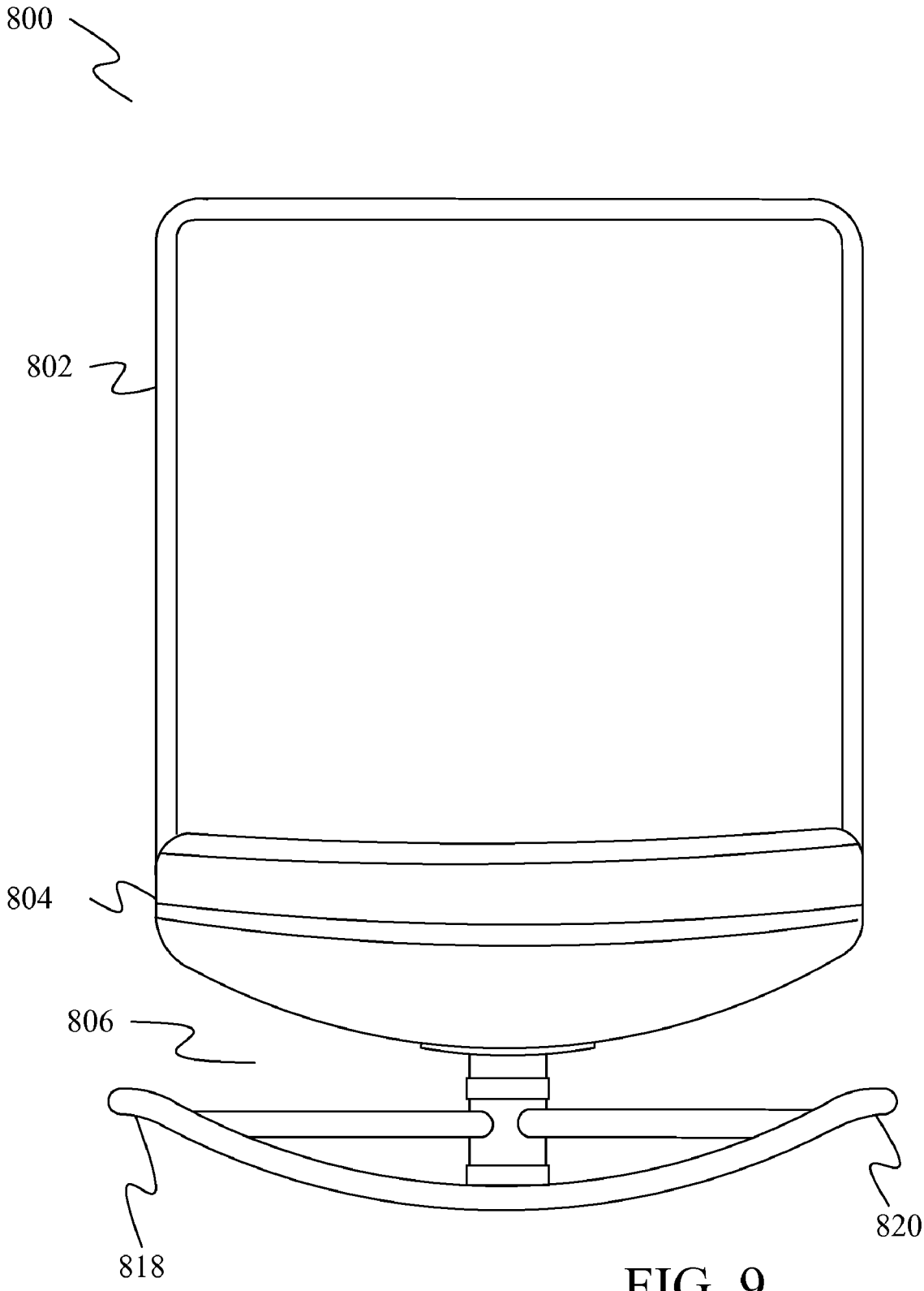
FIG. 9 is a front view of a seat portion of the swivel rocker chair of FIG. 8 with the swivel rocker assembly rotated relative to the seat portion.

Swivel assembly 810 allows seat 804 and back 802 to be rotated relative to rockers 808 as shown in FIG. 9. In the configuration of FIG. 9, side-to-side rocking is facilitated while providing stability in forward and backward directions relative to the front of seat 804.

Under some embodiments, back 802 is attached to seat 804 by a hinge mechanism that allows back 802 to be rotated relative to seat 804 at the hinge point between back 802 and seat 804. Under some of these embodiments, back 802 may be rotated between a position in which back 802 is reclined backwards so that back 802 and seat 804 are in roughly the same plane to a position where back 802 is folded onto seat 804. In further embodiments, the hinge mechanism includes detents that provide additional resistance to moving back 802 relative to seat 804 at certain orientations of back 802. Such detents help users to quickly position back 802 relative to seat 804 by providing an indication of preferred positions.

Figure 10:
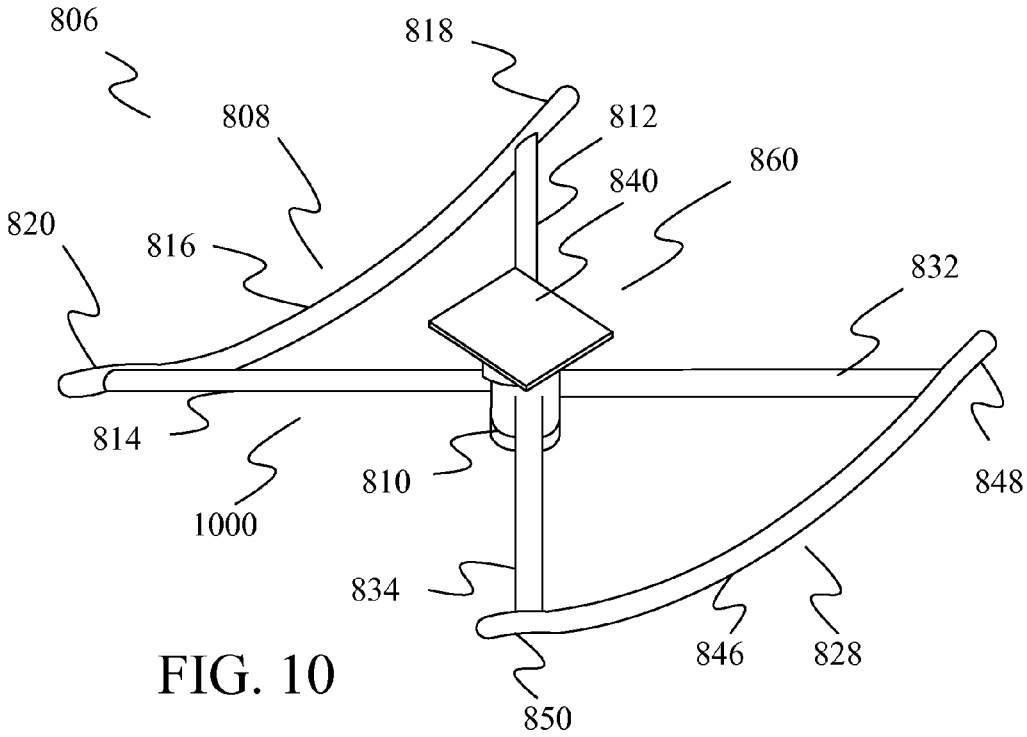
FIG. 10 is a perspective view of a swivel rocker assembly of a second embodiment.

FIG. 10 shows a perspective view of swivel rocker assembly 806 of FIGS. 8 and 9. Swivel rocker assembly 806 includes rocker 808, rocker 828, lateral supports 812, 814, 832 and 834, swivel assembly 810 and mounting bracket 840. Rockers 808 and 828 and lateral supports 812, 814, 832 and 834 together form a rocker assembly 1000, which is also referred to as a rocker portion 1000. Swivel assembly 810 is positioned within a space 860 defined between rockers 808 and 828. Swivel assembly 810, lateral supports 812, 814, 832, 834 and mounting bracket 840 are similar to lateral supports 112, 114, 124, 125, swivel assembly 110 and mounting bracket 116 of FIG. 5. Rocker 808 includes curved portion 816 and extensions 818 and 820. Rocker 828 includes curved portion 846 and extensions 848 and 850. Extensions 818 and 848 extend outside of the radius of curvature of curved portions 816 and 846, respectively, and thereby prevent excessive rocking in a direction along a line of facilitated rocking. Similarly, extensions 820 and 850 extend outside of the radius of curvature of curved portions 816 and 846, respectively, and thereby inhibit excessive rocking in an opposite direction along a line of facilitated rocking.

Under some embodiments, curved portions 816 and 846 have radii of curvature of between 17 and 18 inches and extensions 818, 820, 848 and 850 have radii of curvature of approximately 3 inches, where the curvature of extensions 818 and 820 is in an opposite direction to the curvature of curved portion 916 and the curvature of extensions 848 and 850 are in an opposite direction to the curvature of curved portion 846. Although extensions 818, 820, 848 and 850 are shown as being curved in FIG. 10, in other embodiments, extensions 818, 820, 848 and 850 may be straight or some other shape as long as extensions 818, 820, 848 and 850 extend outside of the radii of curvature of curved portions 816 and 846 such that if swivel rocker chair 800 is rocked toward extensions 818 and 848 or extensions 820 and 850, the respective extensions will inhibit further rocking. In addition, although extensions 818, 820, 848 and 850 are shown as having similar contours in the embodiment of FIG. 10, in other embodiments, one or more of the extensions will have different shapes or be of different sizes from the other extensions.

Figure 11:
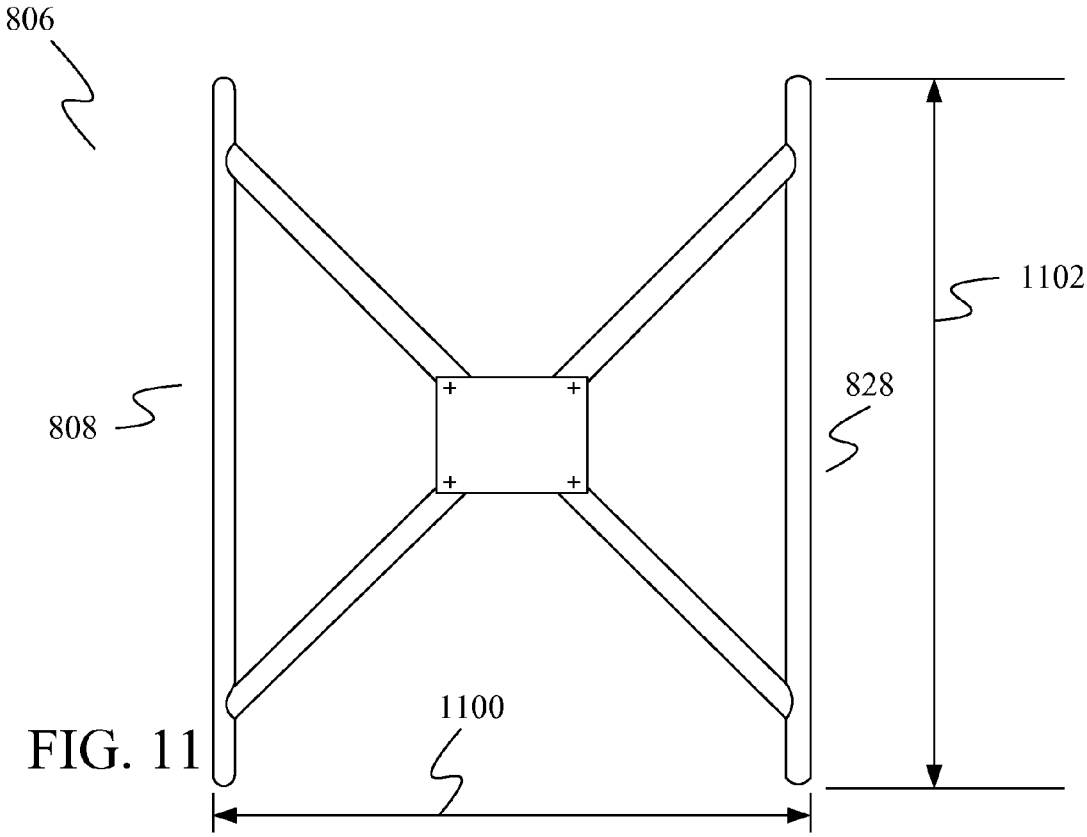
FIG. 11 is a top view of the swivel rocker assembly of a second embodiment.

FIG. 11 provides a top view of swivel rocker assembly 806 of FIG. 10. In FIG. 11, the width 1100 of swivel rocker assembly 806 is measured from the outside of rocker 808 to the outside of rocker 828, which under one embodiment is 16 inches. Rockers 808 and 828 also have a length 1102, which is measured by vertically projecting rockers 808 and 828 onto a horizontal plane and measuring from the front to the back of the projection. Under some embodiments length 1102 is around 19 inches.

Figure 12:
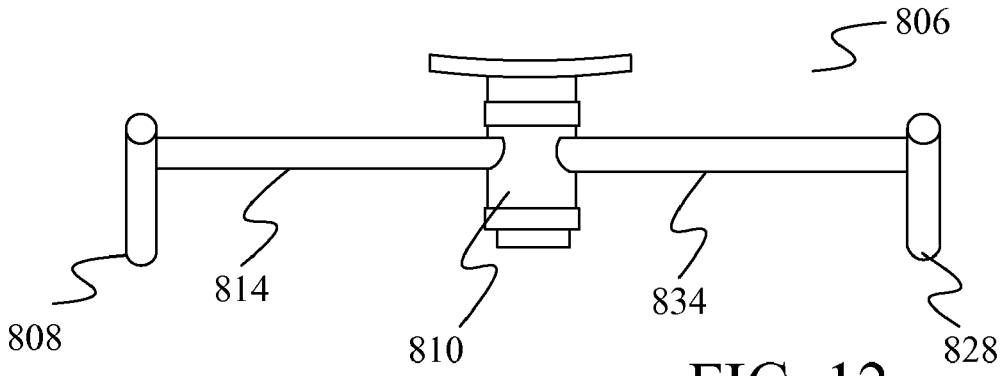
FIG. 12 is a front view of a swivel rocker assembly of a second embodiment.

FIG. 12 provides a front view of swivel rocker assembly 806. In FIG. 12, lateral supports 814 and 834 are shown to extend within a single common plane along with lateral supports 812 and 832. The single common plane can also be seen in the side view of swivel rocker assembly 806 in FIG. 8 where lateral support 812 and lateral support 814 are shown. In FIGS. 8 and 12, a portion of swivel assembly 810 extends below lateral supports 812, 814 and 834 such that at least a portion of swivel assembly 810 is below a common plane that lateral supports 812, 814, 834 and 832 extend within.

Figure 13:
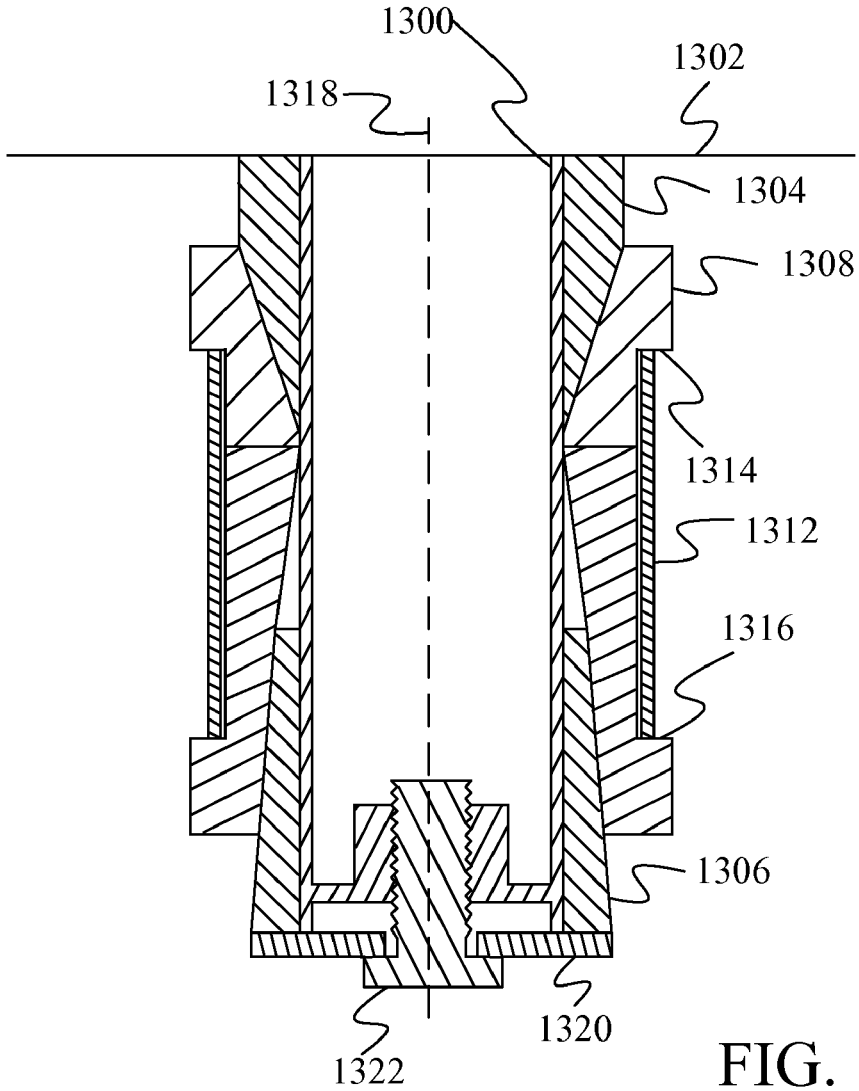
FIG. 13 is a cross-sectional side view of a swivel assembly under one embodiment.

FIG. 13 provides a cross-sectional side view of a swivel assembly such as swivel assemblies 110 and 810. The swivel assembly includes a cylindrical post 1300 that is welded to and extends from a mounting plate 1302, which is similar to mounting plates 116 and 840 discussed above. A cylindrical upper compression fitting 1304 and a cylindrical lower compressing fitting 1306 are concentrically seated around cylindrical post 1300. Upper compression fitting 1304 and lower compression fitting 1306 include angle cuts to maintain a cylindrical upper shoulder piece 1308 and a cylindrical lower shoulder piece 1310 in contact with each other. A cylindrical sleeve 1312 is positioned concentrically about upper shoulder piece 1308 and lower shoulder piece 1310 between an upper edge 1314 of upper shoulder piece 1308 and a lower edge 1316 of lower shoulder piece 1310. Cylindrical sleeve 1312 is free to rotate around upper shoulder piece 1308 and lower shoulder piece 1310 around an axis 1318. Cylindrical sleeve 1312 is connected to the lateral support members that support the rockers, such as lateral supports 112, 114, 124, and 125 of FIG. 5 and lateral supports 812, 814, 832 and 834 of FIG. 10. As such, the rotation of the sleeve is associated with rotation of the rockers relative to the mounting bracket.

Under one embodiment, sleeve 1312 is constructed of steel and is welded to the lateral supports, for example. Under one embodiment, upper shoulder piece 1308 and lower shoulder piece 1310 are made out of a plastic material such as nylon, for example.

Upper compression fitting 1304, lower compression fitting 1306, upper shoulder piece 1308, lower shoulder piece 1310 and sleeve 1312 are maintained in position by a washer 1320 and a bolt 1322 that is screwed into post 1300.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A swivel rocker assembly comprising:

a rocker portion comprising two parallel rockers each having a curved portion that provides rocking in two directions along a first line and limits rocking in other directions and each rocker having an extension extending from an end of the curved portion so as to inbibit rocking in one of the directions along the first line;

a mounting bracket for mounting the swivel rocker assembly to a platform, the mounting bracket having a swivel attachment to the rocker portion such that the rocker portion may be rotated relative to the mounting bracket wherein the swivel attachment comprises a swivel assembly attached to the mounting bracket, each of the parallel rockers being attached to the swivel assembly by two support members, where the support members attach to the parallel rockers along the curved portions of the parallel rockers and wherein the support members attached to the parallel rockers extend in a same plane as each other and wherein the support members attach to the parallel rockers within the plane.

2. The swivel rocker assembly of claim 1 wherein a portion of the swivel assembly is below the plane of the support members.

3. The swivel rocker assembly of claim 1 wherein each curved portion of each rocker further comprises a second end and a second extension extending from the second end, each second extension inhibiting rocking in a second of the two directions along the first line.

4. The swivel rocker assembly of claim 1 wherein the mounting bracket is mounted to a chair.

5. An apparatus comprising:

a seat;

a swivel rocker mounted to the seat, the swivel rocker comprising:

a rocker having a surface designed to contact a floor so as to facilitate rocking in two directions along a line while limiting rocking in other directions and to inhibit excessive rocking in at least one direction along the line, the swivel rocker further comprising a swivel portion such that the seat may be rotated relative to the two directions of facilitated rocking, wherein the swivel portion comprises a post, a cylindrical upper shoulder piece and a cylindrical lower shoulder piece concentrically seated around the post, and a sleeve seated around a portion of the cylindrical upper shoulder piece and a portion of the cylindrical lower shoulder piece such that the cylindrical upper shoulder piece is in contact with the cylindrical lower shoulder piece, wherein the sleeve is coupled to the rocker by a lateral support.

6. The apparatus of claim 5 wherein the swivel rocker comprises two rockers, each rocker having a curved portion designed to contact the floor and an additional portion that inhibits excessive rocking in the one direction along the line.

7. The apparatus of claim 6 wherein the additional portion is curved and extends from an end of the curved portion.

8. The apparatus of claim 6 wherein each rocker further comprises a second additional portion that inhibits excessive rocking in a second direction along the line.

9. The apparatus of claim 6 wherein the swivel rocker further comprises a plurality of lateral supports that couple the rockers to the swivel portion and that are in a same plane as each other.

10. The apparatus of claim 9 wherein a portion of the swivel portion extends below the plane of the lateral supports toward the surface designed to contact the floor.

* * * * *